US012044439B2

(12) United States Patent
Herrs et al.

(10) Patent No.: US 12,044,439 B2
(45) Date of Patent: Jul. 23, 2024

(54) WATER HEATER AND METHOD OF CONTROLLING SAME

(71) Applicant: STIEBEL ELTRON GMBH & CO. KG, Holzminden (DE)

(72) Inventors: Martin Herrs, Hoexter (DE); Hubert Nolte, Hoexter (DE)

(73) Assignee: STIEBEL ELTRON GMBH & CO. KG, Holzminden (DE)

( * ) Notice: Subject to any disclaimer, the term of this patent is extended or adjusted under 35 U.S.C. 154(b) by 0 days.

(21) Appl. No.: 17/703,124

(22) Filed: Mar. 24, 2022

(65) Prior Publication Data

US 2022/0316760 A1 Oct. 6, 2022

(30) Foreign Application Priority Data

Mar. 30, 2021 (DE) ..... 102021108035.5

(51) Int. Cl.

| | |
|---|---|
| ***F24H 9/20*** | (2022.01) |
| ***F24H 15/174*** | (2022.01) |
| ***F24H 15/215*** | (2022.01) |
| ***F24H 15/219*** | (2022.01) |
| ***F24H 15/37*** | (2022.01) |
| ***F24H 15/414*** | (2022.01) |

(52) U.S. Cl.

CPC ..... *F24H 15/174* (2022.01); *F24H 9/2014* (2013.01); *F24H 15/215* (2022.01); *F24H 15/219* (2022.01); *F24H 15/37* (2022.01); *F24H 15/414* (2022.01)

(58) Field of Classification Search

CPC .... F24H 9/2014; F24H 9/2028; F24H 15/215; F24H 15/219; F24H 15/37; F24H 15/238; F24H 15/174

See application file for complete search history.

(56) References Cited

U.S. PATENT DOCUMENTS

2016/0245546 A1* 8/2016 Mihu ..... F24H 15/486

FOREIGN PATENT DOCUMENTS

| | | | | |
|---|---|---|---|---|
| DE | 102014000536 A1 * | 7/2015 | ..... | F24H 1/103 |
| EP | 1310746 A1 | 5/2003 | | |
| FR | 2552210 A1 * | 3/1985 | | |

OTHER PUBLICATIONS

Wojciechowski, DE-102014000536-A1 and translation (Year: 2015).*
Brun, FR-2552210-A1 and translation (Year: 1985).*

* cited by examiner

*Primary Examiner* — Steven S Anderson, II
(74) *Attorney, Agent, or Firm* — Brooks Kushman P.C.

(57) ABSTRACT

A water heater including a cold water intake, a hot water output, a fluid pathway arranged between the cold water intake and the hot water output and adapted to convey water flowing from the cold water intake to the hot water output. A heating element is adapted to heat water that is in the fluid pathway. A power electronics unit is coupled to the heating element. A controller is configured to regulate a temperature of the water in the fluid pathway to an adjustable hot water temperature by controlling the power electronics unit. A water draw-off detector is adapted to detect a water draw-off event and a water sensor is adapted to determine a reference parameter corresponding to a temperature of the water.

17 Claims, 5 Drawing Sheets

WATER HEATER AND METHOD OF CONTROLLING SAME

CROSS-REFERENCE TO RELATED APPLICATIONS

This application claims priority to German Patent Application No. 102021108035.5 filed on Mar. 30, 2021, the disclosure of which is hereby incorporated in its entirety by reference herein.

TECHNICAL FIELD

The present invention relates to an electronic water heater, in particular a continuous-flow heater.

BACKGROUND

Water heaters tend to come in two different variants. In the first variant, water heaters are used that permanently keep water ready that has already been heated to the desired supply temperature. Hot water at the desired temperature is thus provided immediately after a water draw-off operation starts. Such water heaters are used, for example, in canteens or other large kitchens for washing dishes and the like, where a warm-up time is undesirable.

In the second variant, water heaters are used which heat the water only at the beginning of the water draw-off operation, for example standard household continuous-flow heaters in the sanitary area. The hot water pipe and the continuous-flow heater initially contain water that has not been pre-heated, so it takes some time for water at the desired temperature to reach the draw-off point. Compared to sustained heating, this type of operation has an advantage in terms of energy consumption, because heat is not constantly lost. This variant is sometimes referred to as a tankless water heater.

However, due to the fundamentally different concepts for control and regulation, no water heaters are known from the prior art that allow operation with permanent provision of hot water and operation where hot water is provided according to the amount drawn off.

The present invention discloses a versatile water heater.

SUMMARY

According to one aspect of the disclosure, a water heater, such as an electronic continuous-flow heater, includes a cold water intake, a hot water output, a fluid pathway arranged between the cold water intake and the hot water output and adapted to convey water flowing in through the cold water intake to the hot water output, a heating element adapted to heat water that is in the fluid pathway, a power electronics unit coupled to the heating element, a controller configured to regulate control the temperature of the water in the fluid pathway to an adjustable hot water temperature, referred to as the temperature setpoint value, by controlling the power electronics unit, a water draw-off detection means adapted to detect a water draw-off event, a water sensor adapted to determine a reference parameter corresponding to the water temperature.

The water heater further includes an adjusting means, such as a jumper switch, that allows the operation of the water heater to be adjusted between a flow-activated operating mode and a standby operating mode in which the water is kept at a standby temperature.

The water heater makes it possible, by adjustment using the adjusting means, to switch between the energy-saving, flow-activated operating mode and the standby operating mode in which the hot water is provided immediately. In one embodiment, the changeover can be done by flipping the jumper switch. In other embodiments, a changeover is possible only during the manufacturing process, for example by entering parameters in a software implementation. This simplifies certification requirements and at the same time allows several different products to be offered that do not differ technically in respect of their electronics hardware, thus reducing the manufacturing costs.

The water draw-off detection means may include a flow rate sensor, a rocker switch, and/or a noise sensor. Other suitable devices for water-draw detection may also be used.

The water sensor may be a temperature sensor. Other sensors that measure a reference parameter corresponding to the water temperature are also conceivable as a water sensor. In one embodiment, the water temperature is measured in the vicinity of the hot water output, although other locations for temperature measurement are also conceivable.

The water sensor may be embodied as a hot water sensor adapted to determine a reference parameter corresponding to the water temperature in the vicinity of the hot water output.

The water heater may further include a cold water sensor that may measure a water temperature at the vicinity of the cold water intake.

The cold water sensor and the hot water sensor determine the water temperature at the intake into and at the output out of the water heater, respectively. In the vicinity of the cold water intake, and in the vicinity of the hot water output, respectively, is therefore to be understood in functional terms as meaning that the cold water sensor, or the hot water sensor, is disposed in such a way that it is possible to determine the temperature of the water flowing into or out of the water heater. The cold water sensor thus allows the temperature of the inflowing cold water to be determined. The hot water sensor determines the reference temperature of water leaving the water heater during operation of the water heater, when a stream of water is flowing through the fluid pathway. The water temperature, such as the temperature of the water flowing out of the water heater, is regulated to the temperature setpoint value by the controller. After the water heater is switched off, the temperature of the hot water sensor approaches the temperature of the cold water sensor due to loss of heat.

The standby temperature may be approximately equal to the temperature setpoint value, such as at most 10 Kelvin (K) above or below the temperature setpoint value.

In one embodiment, the standby temperature is approximately at the value of the temperature setpoint value for the flow-activated operating mode. Thus, when switching from the standby operating mode to the flow-activated operating mode, water flowing out of the water heater is supplied promptly or immediately at the desired temperature setpoint value, or at a temperature which is close to the temperature setpoint value of the flow-activated operating mode, or slightly above or below it.

In another embodiment, a specific desired temperature difference for the standby temperature is specified, which temperature difference is defined as being above or below the temperature setpoint value specified for flow-activated operation, such as a temperature difference of approximately 10 K or less, of alternatively a temperature difference of approximately 5 K, 4 K, 3 K, 2 K or 1 K relative to the temperature setpoint value specified in flow-activated operation. When water draw-off begins, water is may be supplied for an initial moment at a somewhat higher or lower temperature than a temperature setpoint value specified in flow-activated operation, for example, for as long as required in flow-activated operation for an exchange of water, corresponding approximately to the volume of water in the fluid pathway during standby operation, which is practice takes a few seconds or fractions of a second.

The power electronics unit is preferably thermally coupled for cooling to a region of the fluid pathway that is upstream from the heating element, i.e., preceding it in the direction of flow.

Power electronics units may need to be cooled during operation. In this embodiment, this is achieved by using the water in the water heater for cooling.

The power electronics unit may include a power triac, a control triac, such as an opto-triac, which is connected to a gate electrode of the power triac for triggering the power triac, and a voltage-dependent resistor connected in parallel with the control triac.

The control triac allows the power triac to be switched or triggered with a low current. The power triac of the power electronics unit may be cooled. The voltage-dependent resistor, also called a varistor, protects the power electronics unit against sudden overvoltage from the mains, caused, for example, by lightning or by inductive loads starting or stopping.

A resistor connected downstream from the control triac and the voltage-dependent resistor preferably short-circuits the power triac in order to limit the current flowing through the gate electrode of the power triac.

The voltage-dependent resistor or varistor usually has the disadvantage that when the ambient temperature increases from about 50° C. inside the housing of the water heater, a leakage current triggers the gate of the power triac in such a way that the gate fires unintentionally and activates the heating element or elements, thus resulting in an even higher temperature of the control center inside the water heater. This unintentional firing of the power triac due to the occurrence of a leakage current is thus prevented. A high ambient temperature of the power triac during operation with or without heating can also cause unintentional triggering of the power triac.

The downstream resistor is preferably selected according to a maximum temperature to be complied with inside the water heater.

The higher the resistance of the downstream resistor, the lower the maximum permissible temperature. For example, for a resistor in the range of 500Ω, the temperature may be limited to 83° C., whereas the temperature is limited to a higher value of 90° C. in the case of a 300Ω resistor. These values are only examples, of course, which values may also be different in other cases, depending on the specification of the components. Alternatively or additionally, the downstream resistor may be selected as an NTC with a corresponding characteristic curve.

At least one resistor may be arranged in series with the control triac. The resistor, for example in the range of a few kΩ, protects the control triac.

The water heater may include a plurality of modular heating cells, wherein each heating cell includes a cold water intake, a hot water output, a fluid pathway between the cold water intake and the hot water output, a heating element and a power electronics unit, wherein the controller is configured to regulate the temperature of the water in the fluid pathway through all the heating cells to an adjustable hot water temperature by controlling the power electronics units of all the heating cells.

The controller may be configured to determine a feedforward heating power based on a signal from the water draw-off detection means and a temperature difference between the temperature setpoint value and the water temperature in the vicinity of the cold water intake, determine a temperature deviation by comparing the temperature in the vicinity of the hot water output with the temperature setpoint value, regulate the heating power in order to reduce the temperature deviation as a control deviation as soon as the temperature deviation is at most a temperature threshold value, in particular at most 10 K.

The feedforward heating power is therefore the heating power which is applied to the heating element(s) in order to heat the water to the temperature setpoint value. In this embodiment, the heating power is not adjusted until the deviation from the temperature setpoint value is at most a temperature threshold value. This prevents adjustment from being carried out immediately after heating operation starts, and therefore prevents too high a heating power being set, which would result in water being provided at too hot a temperature. Adjustment of the heating power can stop, for example, when the temperature deviation is less than a second temperature threshold value away from the temperature setpoint value, which deviation may be one Kelvin, for example. This control is present in the flow-activated operating mode, in particular, but is also used in the standby operating mode whenever a water draw-off event is detected by the water draw-off detection means.

The controller is preferably configured to detect the end of a water draw-off operation, in particular by a drop in the signal from the water draw-off detection means, block any restarting of the heating element for a specific period of time, wherein the specific period of time is determined according to the reference parameter corresponding to the water temperature and particularly preferably according to the magnitude of a measured excess temperature.

After water draw-off has ended, the temperature increases initially due to inertia. In this embodiment, the restarting of the heating element(s) is blocked, e.g., temporarily, in order to prevent overshoot. The temperature information which is then provided by the water sensor can be referred to as the excess temperature and determines the duration of the time delay. It is thus possible, to prevent any build-up of the output temperature if water is drawn off in quick succession. Operation according to this embodiment is suitable for both the standby operating mode and the flow-activated operating mode.

In the standby operating mode, the controller may be configured to activate a restart delay in order to delay the restarting of the heating element after each heating operation, deactivate the restart delay as soon as the reference parameter corresponding to the water temperature is lower than the temperature setpoint value by a predetermined threshold value, in particular 10 K, activate the heating element for a predetermined period of time, in particular for between 5 and 20 seconds, when the restart delay is deactivated.

In the standby operating mode, it may be important to decide when to operate the heating elements or the heating element in order to keep the water contained in the fluid pathway in the region of the temperature setpoint value. According to this aspect, a hysteresis is proposed for this purpose that does not allow the heating elements to be switched on until the water temperature is already significantly below the temperature setpoint value.

According to another aspect of the invention, a water heater having a power electronics unit is provided. The power electronics unit includes a power triac, a control triac, e.g., an opto-triac, that is connected to a gate electrode of the power triac for triggering the power triac, a voltage-dependent resistor connected in parallel with the control triac, and a resistor that is connected downstream from the control triac and the voltage-dependent resistor and that short-circuits the power triac to limit the voltage through the gate electrode of the power triac.

According to another aspect, such a power electronics unit for a water heater is itself proposed.

According to a further aspect, a method of controlling a water heater as disclosed is proposed. The method includes determining a feedforward heating power based on a signal from the water draw-off detection means and a temperature difference between the temperature setpoint value and the water temperature in the vicinity of the cold water intake, determining a temperature deviation by comparing a temperature in the vicinity of the hot water output with the temperature setpoint value, regulating the heating power in order to reduce the temperature deviation as a control deviation as soon as the temperature deviation is at most a temperature threshold value, in particular at most 10 K.

Alternatively or additionally, the method further includes detecting the end of a water draw-off operation, in particular by a drop in the signal from the flow rate sensor, blocking any restarting of the heating element for a specific period of time, wherein the specific period of time is determined according to the reference parameter corresponding to the water temperature and particularly preferably according to the magnitude of a measured excess temperature, The excess temperature is formed, in particular, by the positive temperature difference between the water temperature at the output and the setpoint value set for the water temperature at the output.

Operation of the water heater is adjustable between a flow-activated operating mode and a standby operating mode in which the water is kept at a standby temperature, wherein the method preferably further comprises, in the standby operating mode, the steps of: activating a restart delay in order to delay the restarting of the heating element after each heating operation, deactivating the restart delay as soon as the reference parameter corresponding to the water temperature is lower than the temperature setpoint value by a predetermined threshold value, in particular 10 K, activating the heating element for a predetermined period of time, in particular for between 5 and 20 seconds, when the restart delay is deactivated.

The method according to this aspect achieves the same advantages as the water heater described above and can be combined with each of the embodiments of the water heater described as preferable in the foregoing.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
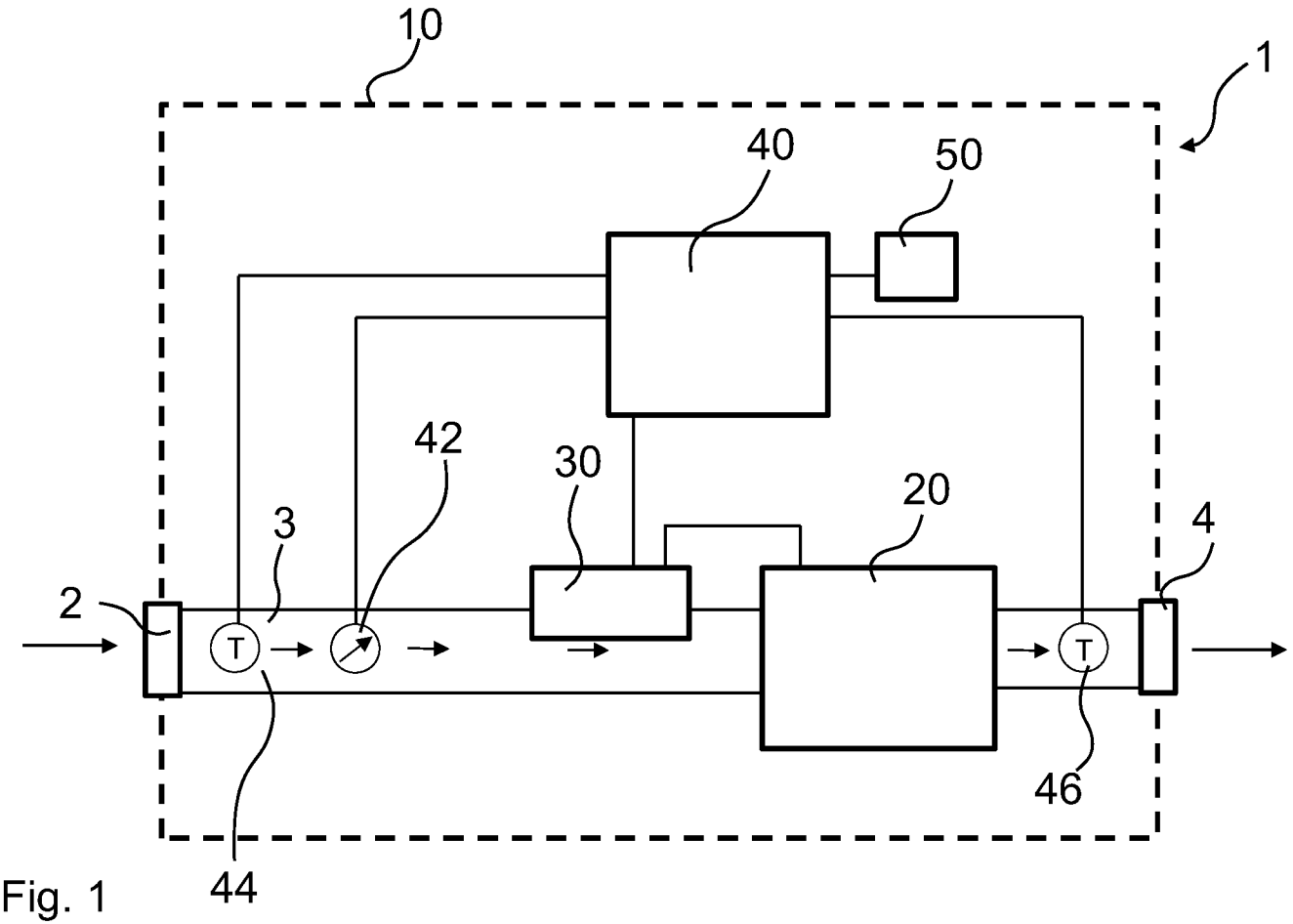
FIG. 1 shows a water heater, in schematic form and by way of example.

FIG. 1 shows, in schematic form and by way of example, a water heater 1, for example an electronic continuous-flow heater. Water heater 1 includes a cold water intake 2 (also known as a cold water inlet port) and a hot water output 4 (also known as a hot water outlet port) for connecting to a draw-off point. Water heater 1 can be connected in a pressurized or in a non-pressurized form. Water flowing into cold water intake 2 is conducted via a fluid pathway 3 through water heater 1, heated therein and then dispensed via hot water output 4, for example, to a draw-off point. While water flows through water heater 1, a heating element 20 heats the water that is in fluid pathway 3.

Although a single heating element 20 is shown, the water heater 1 may include a plurality of heating elements 20 that may be arraigned in series. Heating elements 20 may be arranged in individual, modularly arrangeable heating cells. For example, each of the heating elements 20 can allow a power output of between 6 and 12 kW.

In the view shown by way of example, a power electronics unit 30 coupled to heating element 20 is shown spatially separated. In other embodiments, power electronics unit 30 can also be integrated with heating element 20, as shown, for example, in FIG. 2. Power electronics unit 30 is in thermal contact with a region of fluid pathway 3, such that dissipative heat from power electronics unit 30 is transferred to the water in fluid pathway 3 before it is heated by heating element.

Although fluid pathway 3 is shown as a linear pathway, the pathway 3 may meander through water heater 1 to save space.

A controller 40 of water heater 1 is in signal communication with a cold water sensor 44 for detecting the temperature of the cold water flowing in, a water draw-off detection means 42 adapted to detect a flow of water through fluid pathway 3, and a hot water sensor 46 adapted to determine the water temperature in the fluid pathway in the vicinity of the hot water output 4, i.e., after discharge from heating element 20. Water draw-off detection means 42 includes, for example, a flow rate sensor, a rocker switch and/or a noise sensor.

Controller 40 is configured to control water heater 1 in an operating mode, and in particular to control the temperature of the water in the fluid pathway by controlling the power electronics unit 30 on the basis of a temperature setpoint value. The temperature setpoint value is preferably adjustable.

The operating mode of water heater 1 that controller 40 allows can be changed using adjusting means 50. That is, the adjusting means 50 is used to change the operating mode of the water heater. The adjusting means 50 can distinguish between operation in a flow-activated operating mode and operation in a standby operating mode. Adjusting means 50 may be provided in the form of a jumper switch, i.e., as a mechanical adjusting means. Alternatively, adjustment can be performed using a software switch, for example, a software flag. In the flow-activated operating mode, a water draw-off event, i.e., the presence of flow through fluid pathway 3, is detected by a flow rate sensor 42, and heating of the water in fluid pathway 3 is triggered only if a water draw-off event is actually present (detected). This prevents any loss of heat due to constant provision of heated water.

The situation is different in the standby operating mode, in which the temperature of the water in fluid pathway 3 is preferably kept at the temperature setpoint value during the entire operating time. This ensures that hot water is discharged from hot water output 4 even at the start of draw-off. The standby operating mode is suitable in areas of application where there is frequent demand, for example in canteens. The heat losses that then occur are negligible due to frequent use. It is possible, for example, to activate the standby operating mode during particular periods, such as during the periods that a canteen is in operation. In that case, it is possible to switch to the flow-activated operating mode during night-time operation, or alternatively the water heater can be switched off completely when not in use. It is in this sense that the expression "constant provision of heated water" is to be understood.

Finally, water heater 1 is surrounded by a housing 10 that may also be omitted in other embodiments. Water heater 1 is provided, for example, for three-phase networks in star and delta connection and may be suitable for a power range between 12 and 144 kW.

Figure 2:
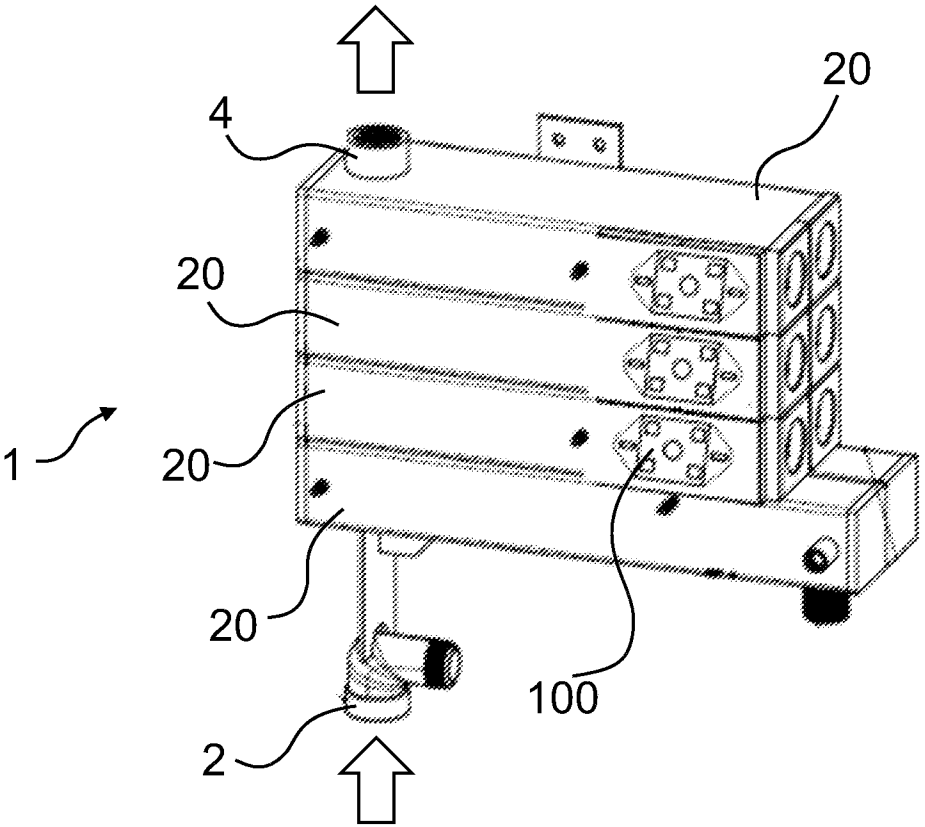
FIG. 2 shows a stack of several heating elements, in schematic form and by way of example.

FIG. 2 shows part of water heater 1 in schematic form and by way of example. The meandering arrangement of several heating elements 20 is shown here. Based on the arrangement and quantity of multiple heating elements 20, it is possible to adjust the amount of power according to need. Each heating element 20 may be protected by a manual safety switch 100.

Figure 3:
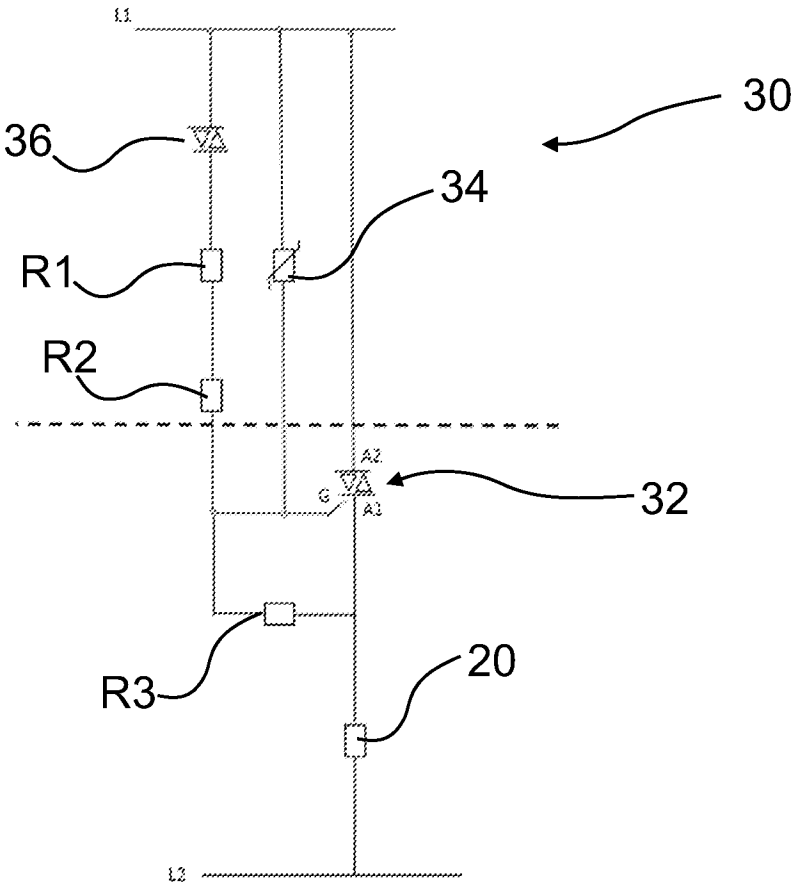
FIG. 3 shows, in schematic form and by way of example, a circuit diagram of a power electronics unit with a heating element.

FIG. 3 shows, in schematic form and by way of example, a circuit diagram of a power electronics unit 30. Power electronics unit 30 is arranged between a first conductor L1 and a second conductor L2 and switches a heating element 20 by power triac 32. Power triac 32 is triggered via a control triac 36, which may be an opto-triac, and is connected to the gate electrode of power triac 32. Power triac 32 becomes conductive between the two main electrodes A1 and A2 due to the control current that is then applied to gate electrode G. In order to protect control triac 36, a first resistor R1 and an optional second resistor R2 are connected in series to control triac 36. In this example, the resistors can each be 2.7 kΩ, although other values are also conceivable. A voltage-dependent resistor 34, also called a varistor, is connected in parallel with control triac 36 and protects power electronics unit 30 against sudden overvoltage from the mains, caused, for example, by lightning or by inductive loads starting or stopping.

However, the disadvantage of this arrangement of voltage-dependent resistor 34 is that, when the ambient temperature in water heater 1 increases, a leakage current through voltage-dependent resistor 34 triggers the gate of power triac 32 in such a way that it fired unintentionally and activates heating element 20. This results in an even higher temperature in the control center of water heater 1. To solve this, a resistor R3 is arranged downstream, which is connected downstream from the control triac and voltage-dependent resistor 34 and which short-circuits control triac 36 in such a way that the current through gate electrode G of power triac 32 is limited.

By limiting the leakage current occurring, the arrangement of resistor R3 thus prevents the unintentional firing of power triac 32. By selecting the resistance of resistor R3 accordingly, it is possible to set the temperature limit inside water heater 1. A higher resistance value will basically limit the temperature inside the housing to a lower ambient temperature.

In the following, the flow-activated operating mode is referred to as the "CE" mode, and the standby operating mode is referred to as the "CF" mode.

Figure 4:
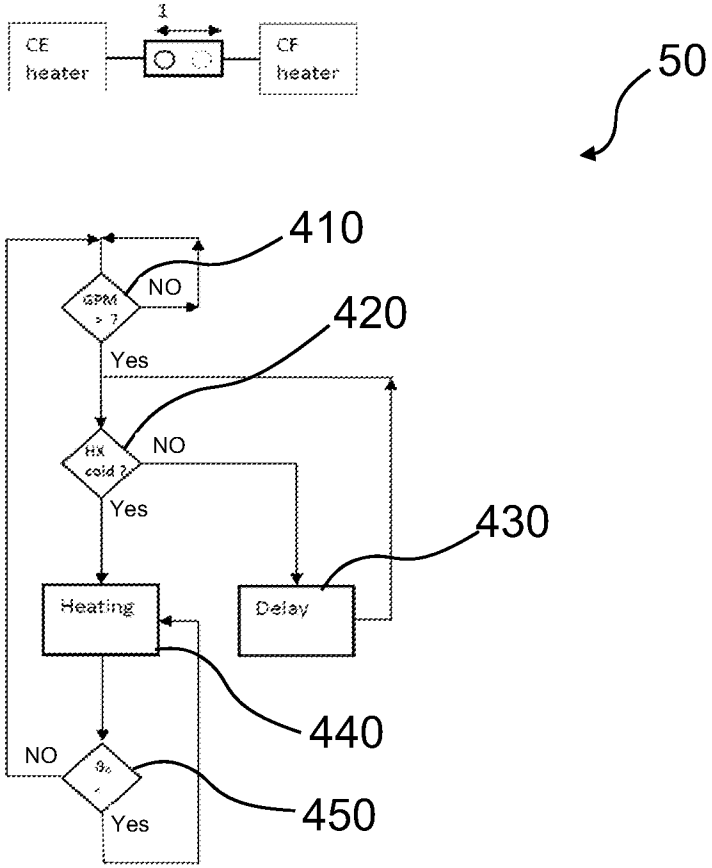
FIG. 4 shows, in schematic form and by way of example, a flow diagram of a flow-activated operating mode of the water heater.

FIG. 4 shows, in schematic form and by way of example, a flow diagram of the operation of water heater 1, made possible by controller 40, for example, when adjusting means 50 has adjusted a setting to the flow-activated operating mode, i.e., the CE mode.

In a first query 410, a test is performed to determine whether a water draw-off event is present or not. The signal from flow sensor 42, for example, is used for this purpose and compared with a predetermined threshold value. Flow rate sensor 42 can output either a binary signal, i.e., "ON" or "OFF", or a signal that is proportional to the flow rate. Other kinds of signal transmission from flow sensor 42 are also possible. If no water draw-off event is detected, the method starts anew with step 410.

In the case where the detected flow rate exceeds the threshold value in step 410, it is tested in step 420 whether the water temperature sensed by hot water sensor 46 indicates that the hot water is hot or not. That the hot water is hot is understood here to mean that operation of the water heater did not occur until a short time ago. For example, the fact that the difference between the hot water temperature and the cold water temperature determined by cold water sensor 44 exceeds a predetermined threshold value can be used as an assessment. Alternatively, the hot water temperature can be considered as it compares with the temperature setpoint value that has been set.

If it is established that the hot water temperature is "hot" in step 420, a delay time is activated in step 430. The delay time delays reactivation of heating element 20 in order to prevent a build-up of the hot water discharge temperature if water draw-offs occur in quick succession.

The time delay in step 430 is repeated as long the test in step 420 returns a negative result.

If the test in step 420 is successful, heating operation is switched on in step 440. This means that heating element 20 is operated under the control of controller 40 in such a way that the hot water temperature is as close as possible to the temperature setpoint value.

The controller may be implemented in such a way that a feedforward heating power is calculated using the flow rate signal and the temperature difference between the cold water intake and the temperature setpoint value. This feedforward heating power is applied via power electronics unit 30 to heating element 20 until the temperature measured at hot water sensor 46 deviates from the temperature setpoint value by a maximum value, for example 10 K. Not until this temperature difference is less than the threshold value is the heating power adjusted and regulated until the control deviation between the hot water temperature and the temperature setpoint value meets the control target, which corresponds, for example, to a deviation of at most 1 K. Heating is continued in step 450 until the drawn-off volumetric flow rate measured by the flow rate sensor is less than the minimum drawn-off volumetric flow rate that has been set, which is the case, for example, when the water draw-off event is terminated.

Figure 5:
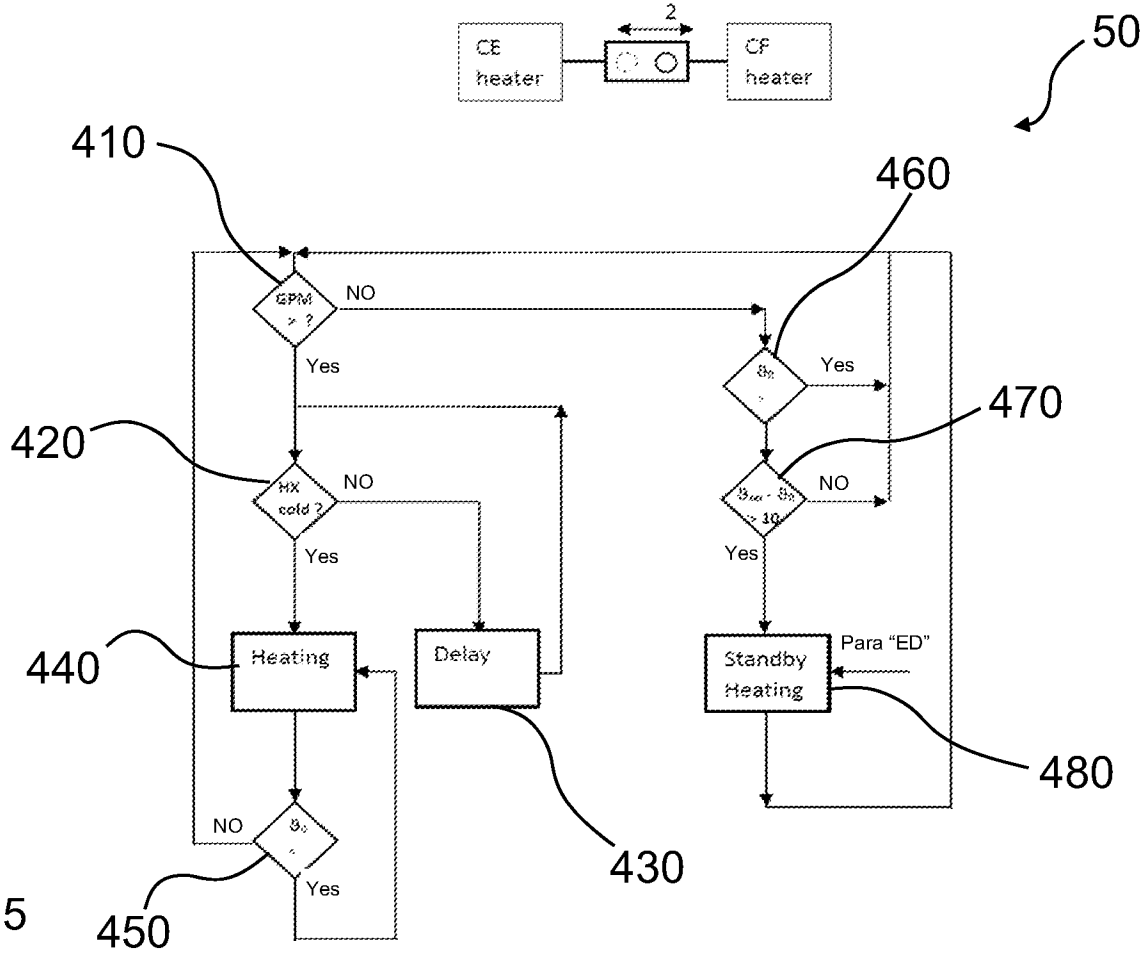
FIG. 5 shows, in schematic form and by way of example, a flow diagram of a standby operating mode of the water heater.

FIG. 5 shows, in schematic form and by way of example, a flow diagram in which adjusting means 50 adjusts the operating setting to the "CF" operating mode, i.e., to the standby operating mode. What is shown, therefore, is the control of standby operation, in steps 460 to 480, in addition to the discharge shown in FIG. 4.

In standby operating mode, the restart delay in step 430 is also active after every heating phase. This corresponds to additional step 460.

As soon as the temperature of the hot water measured at hot water sensor 46 is more than a predetermined threshold value, for example 10 K, is less than the temperature setpoint value that has been set, the response to the test performed in step 470 is "Yes". Not until then is step 480 of standby heating operation, i.e., the activation of all the heating elements 20, carried out. Heating elements 20 are preferably activated for a fixed duration, for example for 10 seconds.

The restart delay according to step 460 and the hysteresis test according to step 470 are repeated.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A water heater comprising:
- a cold water intake;
- a hot water output;
- a fluid pathway arranged between the cold water intake and the hot water output and adapted to convey water flowing from the cold water intake to the hot water output;
- a heating element adapted to heat water that is in the fluid pathway;
- a power electronics unit coupled to the heating element, wherein the power electronics unit comprises:
  - a power triac,
  - an opto-triac that is connected to a gate electrode of the power triac for triggering the power triac, and
  - a voltage-dependent resistor connected in parallel with the opto-triac;
- a controller configured to regulate a temperature of the water in the fluid pathway to an adjustable hot water temperature by controlling the power electronics unit;
- a water draw-off detector adapted to detect a water draw-off event;
- a water sensor adapted to determine a reference parameter corresponding to a temperature of the water; and
- an adjusting means for adjusting between a flow-activated operating mode and a standby operating mode in which the water is kept at a standby temperature.

2. The water heater according to claim 1, wherein the water draw-off detector includes a flow rate sensor, a rocker switch, or a noise sensor.

3. The water heater according to claim 1, wherein the water sensor includes a temperature sensor.

4. The water heater according to claim 1, wherein the water sensor includes a hot water sensor adapted to determine a reference parameter corresponding to a temperature of the water in a vicinity of the hot water output.

5. The water heater according to claim 4, further comprising a cold water sensor adapted to determine a temperature of the water in a vicinity of the cold water intake.

6. The water heater according to claim 1, wherein the adjustable hot water temperature is set to a temperature setpoint value, and wherein the standby temperature is, at most, 10 K above or below the temperature setpoint value.

7. The water heater according to claim 1, wherein the power electronics unit is thermally coupled to a region of the fluid pathway that is upstream from the heating element to thermally regulate the power electronics.

8. The water heater according to claim 1, wherein a resistor is connected downstream of the opto-triac and the voltage-dependent resistor short-circuits the power triac to limit the current flowing through the gate electrode of the power triac.

9. The water heater according to claim 8, wherein the downstream resistor is selected according to a maximum operating temperature inside the water heater.

10. The water heater according to claim 1, wherein at least one resistor is arranged in series with the opto-triac.

11. The water heater according to claim 1, wherein the water heater includes a plurality of modular heating cells, wherein each heating cell includes a cold water intake, a hot water output, a fluid pathway between said cold water intake and said hot water output, a heating element and a power electronics unit, wherein the controller is configured to regulate the temperatures of the water in the fluid pathways through all the heating cells to an adjustable hot water temperature by controlling the power electronics units of all the heating cells.

12. The water heater according to claim 1, wherein the water sensor includes a hot water sensor adapted to determine a reference parameter corresponding to a temperature of the water in the vicinity of the hot water output,
- further comprising a cold water sensor adapted to determine a temperature of the water in the vicinity of the cold water intake, wherein
- the controller is configured to:
  - determine a feedforward heating power based on a signal from the water draw-off detector and a temperature difference between the adjustable hot water temperature and a water temperature in a vicinity of the cold water intake,
    - determine a temperature deviation by comparing the temperature in the vicinity of the hot water output with the adjustable hot water temperature, and
    - regulate the heating power in order to reduce the temperature deviation as a control deviation as soon as the temperature deviation is at most a temperature threshold value.

13. The water heater according to claim 1, wherein the controller is configured to:
- detect an end of a water draw-off operation by sensing a drop in a signal from the water draw-off detector,
- inhibit restarting of the heating element for a specific period of time, wherein the specific period of time is determined according to the reference parameter corresponding to the water temperature.

14. The water heater according to claim 1, wherein the controller is further configured, in the standby operating mode, to:
- activate a restart delay to delay restarting of the heating element after each heating operation,
- deactivate the restart delay responsive to the reference parameter corresponding to the water temperature being lower than the adjustable hot water temperature by a predetermined threshold value, and activate the heating element for a predetermined period of time when the restart delay is deactivated.

15. A water heater comprising:

a cold water intake;

a hot water output;

a fluid pathway arranged between the cold water intake and the hot water output and adapted to convey water flowing from the cold water intake to the hot water output;

a heating element adapted to heat water that is in the fluid pathway;

a power electronics unit coupled to the heating element, wherein the power electronics unit comprises:

a power triac, a control triac that is connected to a gate electrode of the power triac for triggering the power triac, and a voltage-dependent resistor connected in parallel with the control triac;

a controller configured to regulate a temperature of the water in the fluid pathway to an adjustable hot water temperature by controlling the power electronics unit;

a water draw-off detector adapted to detect a water draw-off event;

a water sensor adapted to determine a reference parameter corresponding to a temperature of the water; and an adjusting means for adjusting between a flow-activated operating mode and a standby operating mode in which the water is kept at a standby temperature.

16. The water heater according to claim 15, wherein a resistor is connected downstream of the control triac and the voltage-dependent resistor short-circuits the power triac to limit the current flowing through the gate electrode of the power triac.

17. The water heater according to claim 15, wherein the downstream resistor is selected according to a maximum operating temperature inside the water heater.

* * * * *